United States Patent [19]

Nakamura et al.

[11] Patent Number: 4,608,010

[45] Date of Patent: Aug. 26, 1986

[54] DEVICE FOR ADJUSTING THE VERTICAL POSITION OF WICK FOR OIL BURNER

[75] Inventors: Kazuharu Nakamura, Nagoya; Yutaka Nakanishi, Kounan, both of Japan

[73] Assignee: Toyotomi Kogyo Co., Ltd., Aichi, Japan

[21] Appl. No.: 675,365

[22] Filed: Nov. 27, 1984

[30] Foreign Application Priority Data

Nov. 28, 1983 [JP] Japan ..... 58-183199[U]

[51] Int. Cl.[4] ..... F23N 5/24

[52] U.S. Cl. ..... 431/88; 431/301; 431/307

[58] Field of Search ..... 431/33, 88, 301, 304, 431/307, 315, 316, 317

[56] References Cited

U.S. PATENT DOCUMENTS 4,458,664 7/1984 Uchida et al. ..... 126/96
4,486,170 12/1984 Tsukada et al. ..... 431/88 X

FOREIGN PATENT DOCUMENTS 0142630 11/1970 Japan ..... 431/88
0129535 10/1979 Japan ..... 431/88
0035311 3/1983 Japan ..... 431/304

*Primary Examiner*—Margaret A. Focarino
*Attorney, Agent, or Firm*—Pollock, Vande Sande & Priddy

[57] ABSTRACT

A device for adjusting the vertical position of a wick for an oil burner is disclosed which is capable of effectively and positively keeps the combustion position of the wick within a range of constantly attaining the normal combustion of the oil burner. The wick adjusting device includes a circular member fitted on a wick operating shaft and received in a slidable knob to be moved with the knob. The circular member is formed with a slot in which a pin-like projection of a gear is movably fitted and with which the projection is engaged at the minimum combustion position to prevent the knob from being further rotated in the fire-extinguishing direction during the combustion operation.

8 Claims, 7 Drawing Figures

DEVICE FOR ADJUSTING THE VERTICAL POSITION OF WICK FOR OIL BURNER

BACKGROUND OF THE INVENTION

1. Field of the Invention

This invention relates to a device for adjusting the vertical position of a wick for an oil burner, and more particularly to a device for adjusting the vertical position of a wick for an oil burner which is adapted to keep the vertical position of a wick within a range of carrying out the normal combustion of the oil burner and is suitable for use in an oil burner having an automatic fire-extinguishing mechanism.

2. Description of the Prior Art

The recent development of a combustion cylinder construction for an oil burner allows an oil burner which is capable of adjusting combustion as desired to be put in practical use. However, the appearance of such an oil burner in the market causes the user often to use an oil burner in a state that a wick is lowered below the minimum combustion position as a result of overestimating the capability of the combustion cylinder construction to encounter danger such as abnormal combustion.

Accordingly, it would be highly desirable to develop a device for adjusting the vertical position of a wick for an oil burner which is capable of effectively keeping the combustion position of a wick constantly within a range of accomplishing the normal combustion of the oil burner.

SUMMARY OF THE INVENTION

The present invention has been made in view of the foregoing disadvantage of the prior art.

In accordance with the present invention, there is provided a device for adjusting the vertical position of a wick for an oil burner comprising a wick operating shaft rotated to vertically move said wick; a shaft actuating means for actuating said wick operating shaft, said shaft actuating means being mounted on one end of said wick operating shaft so as to be slidable on said wick operating shaft in the axial direction thereof; a gear means loosely fitted on said wick operating shaft, said gear means having an extension means extending therefrom toward said shaft actuating means; a return spring mounted with respect to said gear means to act on said gear means, said return spring being wound up at an ordinary state; a stopper means adapted to be stationary at an ordinary state so that it is engaged with said gear means to keep said return spring at the wound-up state and prevent said gear means from being rotated by the force of said wound-up return spring, and also adapted, when it is actuated, to be released from the engagement with said gear means so that said wound-up return spring is released to rotate said wick operating shaft to lower said wick to the fire-extinguishing position; an engagement means provided on said wick operating shaft which is adapted to pressingly engage with said extension means of said gear means to wind up said return spring when said wick operating shaft is rotated through said shaft actuating means at the state that said return spring is not wound up; a means for constantly forcing said shaft actuating means toward said gear means; and a regulating means arranged to be moved together with said shaft actuating means, said regulating means being adapted to be engaged with said extension means of said gear means at the minimum combustion position to stop the rotation of said shaft actuating means in the fire-extinguishing direction and released from the engagement with said extension means to allow said shaft actuating means to be rotated in the fire-extinguishing direction when it is pulled against said forcing means.

In accordance with the present invention, there is also provided a device for adjusting the vertical position of a wick for an oil burner comprising a wick operating shaft rotated to vertically move said wick; a knob mounted on the distal end of said wick operating shaft so as to rotate said wick operating shaft and be slidable on said wick operating shaft in the axial direction thereof; a gear loosely fitted on said wick operating shaft and having an extension means provided thereon which comprises a rod mounted on said gear to extend therefrom toward said knob and a pin-like projection mounted on said rod to extend therefrom toward said knob; a return spring fitted on said wick operating shaft to act on said wick operating shaft, said return spring being positioned between an burner body and said gear and wound up at an ordinary state; a stopper means adapted to be stationary at an ordinary state so that it is engaged with said gear to keep said return spring at the wound-up state and prevent said gear from being rotated by the force of said wound-up return spring, said stopper means being also adapted to be released from the engagement with said gear so that said wound-up return spring is released to rotate said wick operating shaft to the fire-extinguishing position, when said stopper means is actuated; a tension spring fitted on said wick operating shaft and received in said knob so as to constantly force said knob toward said gear; a circular member fitted on said wick operating shaft and securely fitted in said knob so at be interposed between said gear and said knob and moved together with said knob, said circular member being circumferentially formed with an arcuate slot in which said pin-like projection of said extension means of said gear is movably fitted in a manner to be abutted against one side end of said slot at the minimum combustion position of said wick to stop the relative movement between said pin-like projection and said slot.

Accordingly, it is an object of the present invention to provide a device for adjusting the vertical position of a wick for an oil burner which is capable of constantly keeping the combustion position of a wick within a range of attaining the normal combustion of the oil burner.

It is another object of the present invention to provide a device for adjusting the vertical position of a wick for an oil burner which is particularly suitable for use in an oil burner including an automatic fire-extinguishing mechanism or a mechanism for forcibly lowering a wick so as to carry out automatic fire-extinguishing in an emergency such as earthquakes or the like.

It is another object of the present invention to provide a device for adjusting the vertical position of a wick for an oil burner which is capable of effectively and positively keeping the combustion position of the wick within a range of carrying out the normal combustion of the oil burner with a simple construction.

It is a further object of the present invention to provide a device for adjusting the vertical position of a wick for an oil burner which is capable of effectively preventing the wick from being stopped at the minimum combustion position to fail in the fire-extinguishing of the oil burner even when an emergency such as earthquakes or the like occurs.

It is still a further object of the present invention to provide a device for adjusting the vertical position of a wick for an oil burner which is capable of eliminating an operation and/or means for pulling a knob so as to correspond to the actuation of an automatic fire-extinguishing mechanism in an emergency.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a schematic view viewed along line III—III of FIG. 2 and showing the positional relationships among a projection, an arcuate slot and a pin member, wherein

DETAILED DESCRIPTION OF THE PREFERRED EMBODIMENT

Now, a device for adjusting the vertical position of a wick for an oil burner according to the present invention will be described hereinafter with reference to the accompanying drawings.

Figure 1:
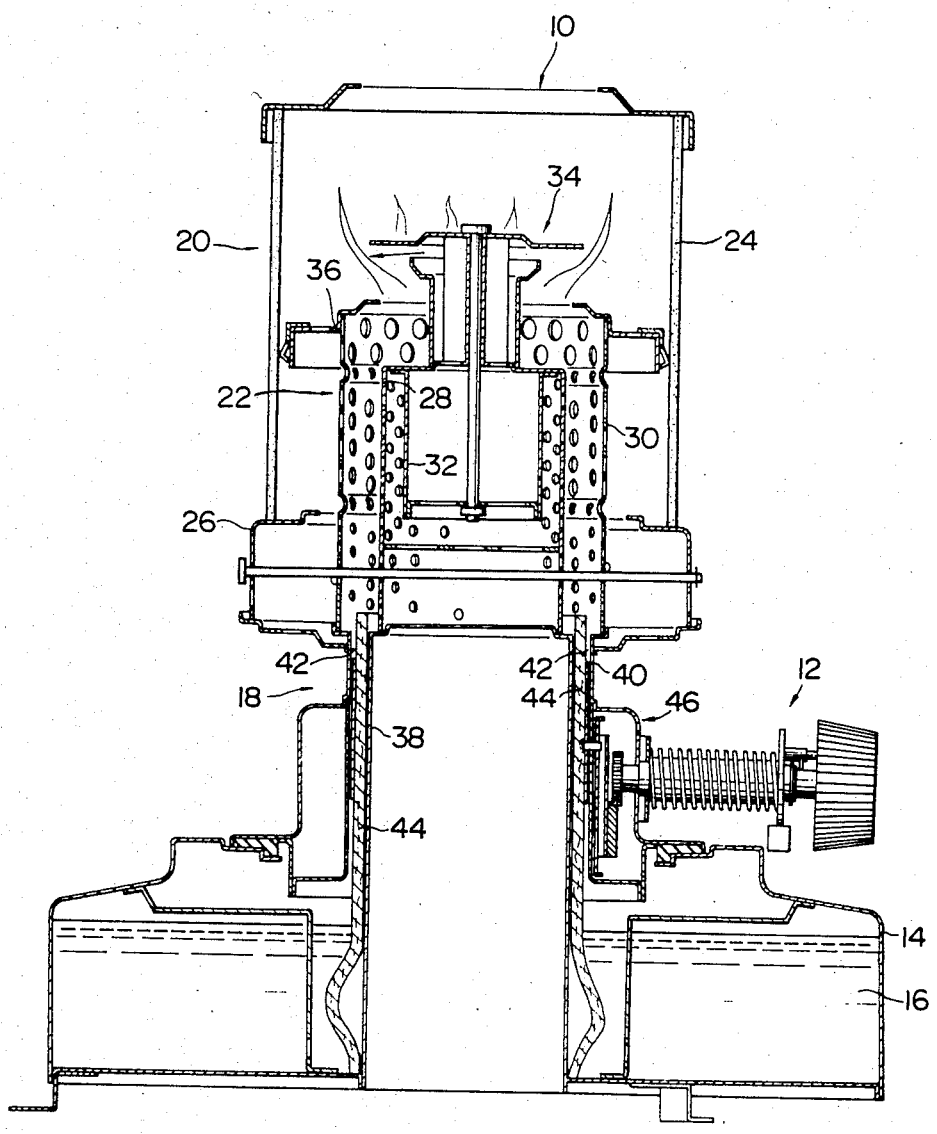
FIG. 1 is a vertical sectional view showing an oil burner taking the form of an oil fired space heater of the red hot type in which an embodiment of a device for adjusting the vertical position of a wick for an oil burner according to the present invention employed therein.

Referring now to FIG. 1, there is schematically illustrated one example of an oil burner which is adapted to employ a device for adjusting the vertical position of a wick according to the present invention. An oil burner generally indicated by reference numeral 10 in FIG. 1 is a red-hot type space heater. However, it should be noted that an oil burner for which a wick adjusting device of the present invention is not limited to such a space heater.

The oil burner 10 illustrated in FIG. 1 is constructed in such a manner as widely known in the art, except a wick adjusting device of the present invention generally designated by reference numeral 12. The oil burner 10 includes an oil tank 14 for storing fuel oil 16 such as kerosene, a wick receiving cylinder 18 arranged on the oil tank 14 so as to be communicated therewith and a combustion cylinder construction 20 disposed on the wick receiving cylinder 18.

The combustion cylinder construction 20 comprises a double combustion cylinder means 22 and a heat-permeable cylinder 25 arranged concentrical with the cylinder means 22 with a space being defined therebetween. The heat-permeable cylinder 24 is supported through a base cylinder 26 on the wick receiving cylinder 18. The double combustion cylinder means 22 comprises an inner cylindrical member 28 and an outer cylindrical member 30 which are arranged concentrical with each other so as to define a space therebetween. The inner and outer cylindrical members each 28 and 30 are provided with a plurality of through-holes. The inner cylindrical member 28 has a central cylinder 32 arranged therein, on which a flame spreading means 34 is mounted so as to be communicated therewith. The outer cylindrical member 30 has an annular top plate 36 provided at the upper end thereof which is formed to outward extend at the outer periphery thereof to the heat-permeable cylinder 24 and allow the inner periphery thereof to be positioned above the inner cylindrical member 28. The outer cylindrical member 30 is also formed with a pair of circumferentially extending recesses of a semi-circle in section.

The wick receiving cylinder 18 has an inner wall 38 and an outer wall 40 which are arranged to define therebetween an annular chamber 42 which is adapted to receive a wick 44 therein and communicated with the space between the inner and outer cylindrical members 28 and 30. When combustion is to be carried out, the wick 44 is raised to the lower portion of the space between the inner and outer cylindrical members 28 and 30.

Figure 2:
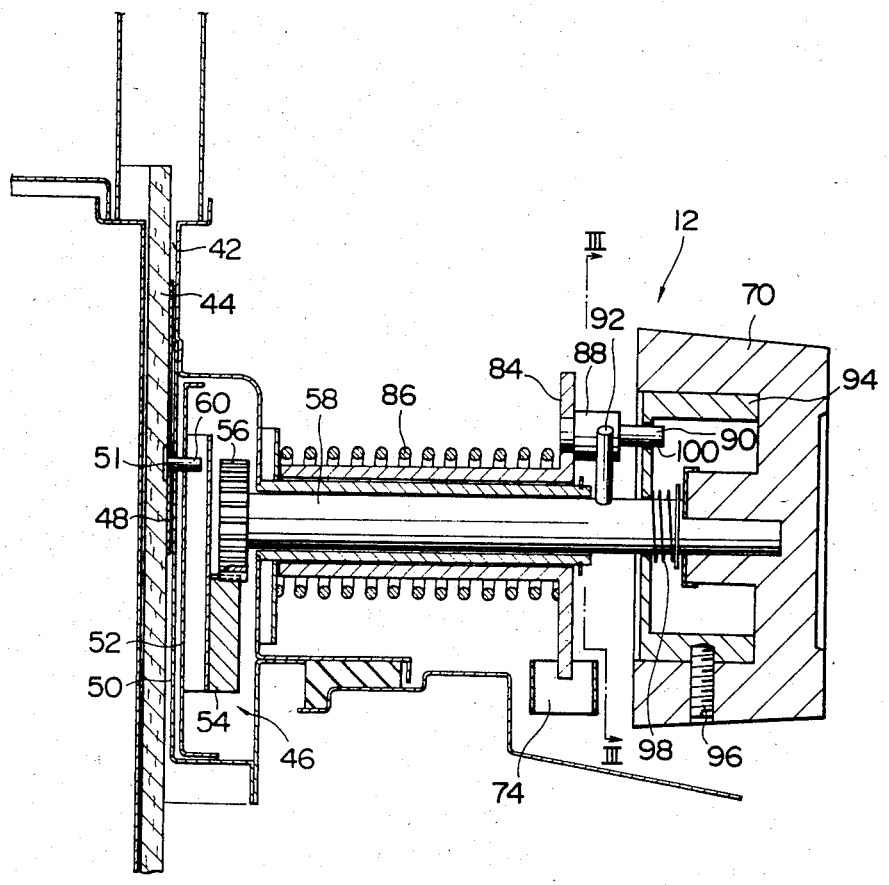
FIG. 2 is a vertical sectional view showing the wick adjusting device shown in FIG. 1.

Reference numeral 46 designates a wick actuating means for vertically moving the wick 44 supported on an annular retaining plate 48. The wick retaining plate 48, as shown in FIG. 2, is disposed between the wick 44 and a lower wall member 50 of the outer wall 40 of the wick receiving chamber 42 to lightly press the wick 44 against the inner wall 38 of the chamber 42. The wick actuating means 46 may be constructed in a manner as known in the art and comprises an actuating plate 52 which is arranged at the outside of the outer wall 40 of the wick receiving chamber 42 to rotate the wick retaining plate 48 and adapted to circumferentially move, a rack 54 mounted on the actuating plate 52 and a pinion 56 provided at one end of a wick operating shaft 58 so as to engage with the rack 54. The rack 54 and pinion 56 are constructed to determine the maximum movable range of the wick 44 or the uppermost position and lowermost position of the wick 44. The connection between the wick retaining plate 48 and the actuating plate 52 may be effected by means of a suitable conventional means such as a connecting pin 60 which is fitted in an oblique slot 51 formed at the lower wall member 50 so as to be movable relative to the slot 51.

The wick adjusting device 12 of the present invention is provided about the wick operating shaft 58 having a knob 70 mounted at the other end thereof so as to be slidable on the shaft 58 in the axial direction thereof which is adapted to be manually actuated to rotate the shaft 58. In the illustrated embodiment, the wick adjusting device 12 is adapted to be used in an oil burner including an automatic fire-extinguishing mechanism generally designated by reference numeral 72 in FIG. 4 and adapted to be actuated automatically or manually in an emergency or the like. The automatic fire-extinguishing mechanism 72 includes a stopper means 74 which is constantly biased at one end thereof in the counterclockwise direction in FIG. 4 by a spring means 75 such as a coiled spring. The stopper means 74 is connected at the other end thereof through a movable plate 76 to a vibration sensing weight 78 arranged on a horizontal support 80 so that the stopper 74 is upward moved at the other end thereof by the weight 78 when it is vibrated or tilted above a predetermined level. Reference numeral 82 designates a manually operating handle. The automatic fire-extinguishing mechanism of such construction is known to those skilled in the art.

The wick adjusting device 20 of the illustrated embodiment, as schematically shown in FIG. 1 and detailedly shown in FIGS. 2 to 4, includes a gear 84 freely fitted on the wick operating shaft 58. The wick operating shaft 58 also has a return spring 86 wound thereon, which is arranged to be interposed between the gear 84 and a burner body. In the embodiment, the return spring 86 comprises a coiled spring fitted on the sleeve portion of the gear 84. The gear 84 is provided on the surface thereof facing the knob 70 with a rod 88 so as to extend therefrom toward the knob 70, and the rod 88 has a pin-like projection 90 mounted on the distal end thereof so as to extend therefrom toward the knob 70. The wick operating shaft 58 is provided with a pin member 92 radially extending therefrom, which serves to engage with the rod 88 to press it to rotate the gear 84 with the wick operating shaft 58, to thereby wind the return spring 86, when the wick operating shaft 58 is rotated in the direction of upward moving the wick 44 in the state that the return spring 86 is released. And, the stopper 74 engages with the gear 84 to prevent the gear 84 from being reversed due to the force of the wound return spring 86, to thereby keep the return spring at the wound-up state unless the automatic fire-extinguishing mechanism 72 is actuated to disengage the stopper 74 from the gear 84.

The wick adjusting device 12 of the illustrated embodiment also includes a regulating means 94 fitted on the wick operating shaft 58 in a manner to be slidable on the shaft 58 in the axial direction of the shaft and rotated with the knob 70. The regulating means 94 is positioned between the gear 84 and the knob 70. In the illustrated embodiment, the regulating means 94 comprises a circular member fitted in the knob 70 so as to be slidable on the wick operating shaft 58 in the longitudinal direction of the wick operating shaft 58 and fixed therein by means of a screw 96 so as to be movable with the knob 70. The knob 70 has a spring 98 received therein which acts to force the knob toward the gear 84. In the illustrated embodiment, the spring 98 is interposed between the circular member 94 and the knob 70.

Figure 3A:
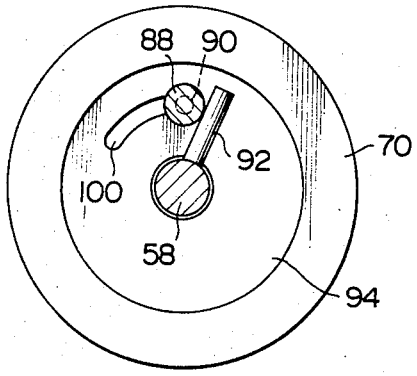
FIGS. 3A, 3B and 3C show the relationships when a wick is at the maximum combustion position, minimum combustion position and fire-extinguishing position, respectively.
Figure 3B:
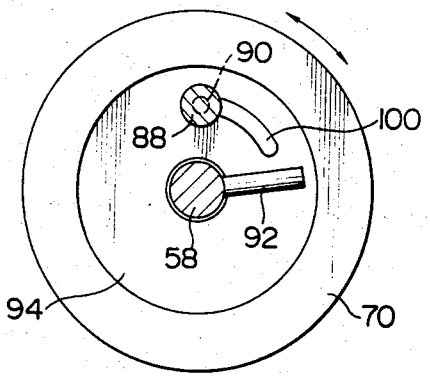
Figure 3C:
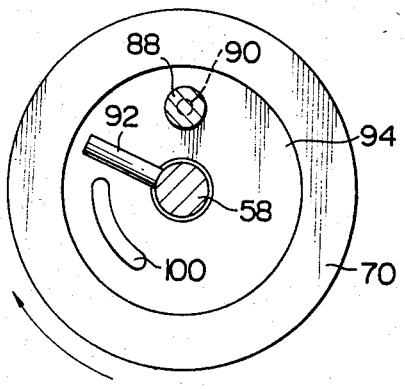

The circular member 94 is formed with a slot 100 of an arcuate shape extending in the circumferential direction, as shown in FIG. 3. The slot 100 is adapted to allow the pin-like projection 90 of the rod 88 to be movably fitted therein and is moved relative to the pin-like projection 90 in the range between the maximum combustion position and the minimum combustion position, as shown in FIGS. 3A and 3B. FIG. 3A shows the positional relationship between the projection 90 and the slot 100 at the maximum combustion position, wherein the right end of the slot is adjacent to the pin-like projection. In the illustrated embodiment, the maximum combustion position of the wick 44 may be determined by the combination of the rack 54 and pinion 56 or the combination of the slot 51 of the outer wall 50 of the wick receiving cylinder 18 and the pin 60. FIG. 3B shows the relationship therebetween at the minimum combustion position wherein the left end of the slot 100 is abutted against the projection 90 to prevent the knob 70 from being further rotated in the wick lowering direction. Thus, it will be noted that the the free relative movement between the pin-like projection 90 and the slot 100 is regulated at the minimum combustion position at which the slot is abutted against the projection. The lowering of the wick 44 from the minimum combustion position to the fire-extinguishing position is carried out in a manner such that the knob 70 is outward pulled against the tension of the spring 98 to release the slot 100 of the circular member 94 from the pin-like projection 90 and concurrently the knob 70 is further rotated in the fire-extinguishing direction, as shown in FIG. 3C.

Now, the operation of the wick adjusting device of the illustrated embodiment constructed as described above will be described with reference to the drawings.

Figure 4A:
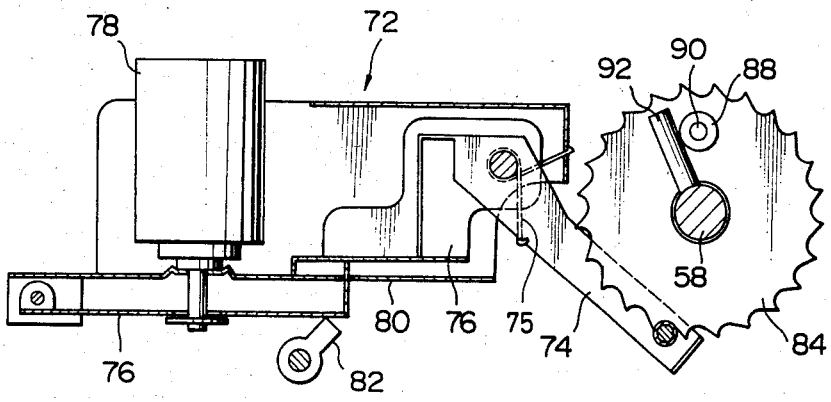
FIG. 4A is a schematic view showing the relationship between an automatic fire-extinguishing mechanism and a device for adjusting the vertical position of a wick for an oil burner according to the present invention wherein a gear of the present device is engaged with a stopper means of the mechanism to keep a return spring at the wound-up state and the present device is at the maximum combustion position.

First, it should be understood that the wick adjusting device 12 is operated at an ordinary state or the state that the return spring 86 is wound up and the stopper means 74 of the fire-extinguishing mechanism 72 is engaged with the gear 84 to prevent the gear 84 from being rotated due to the force of the wound-up return spring 86, as shown in FIG. 4A. When the stopper 74 is disengaged from the gear 84 by the operation of the vibration sensing weight 78 due to earthquakes or the like or by the operation of the handle 82 by an operator, the wound-up return spring 86 is released to cause the gear 84, rod 88 and pin member 92 to be moved together in the counterclockwise direction in FIG. 4A from the position shown in FIG. 4A to that of FIG. 4B, so that the wick 44 may be lowered to the fire-extinguishing position. The handle 82 is adapted to be actuated by an operator when the vibration sensing weight 78 is not properly actuated or any other accident such as abnormal combustion occurs, so that the stopper means 74 may be operated to release the engagement beween the gear 84 and the stopper 74 to lower the wick 44 to the fire-extinguishing position.

Figure 4B:
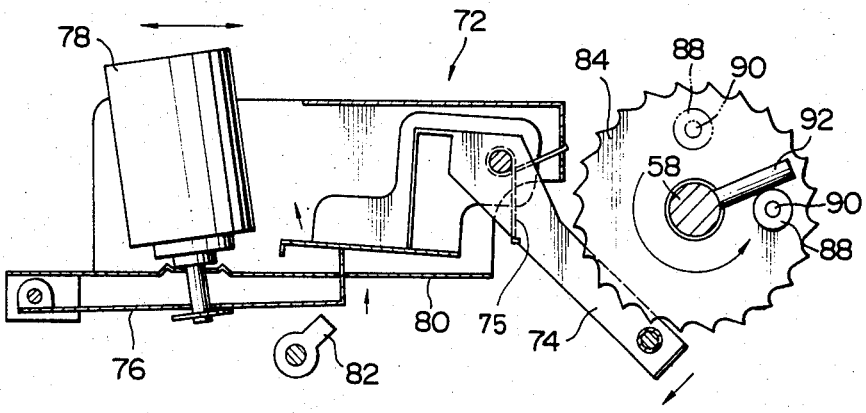
FIG. 4B is a schematic view similar to FIG. 4A wherein a stopper means of the mechanism is released from a gear of the present device to lower a wick to the fire-extinguishing position.

The shift from the position shown in FIG. 4B to that in FIG. 4A is carried out in a manner such that the wick operating shaft 58 is rotated in the clockwise direction through the knob 70 in the state shown in FIG. 4B, so that the pin member 92 pushes the rod 88 to rotate the gear 84 and wind up the return spring 86, as shown in FIG. 4A. In this instance, the wound-up return spring 86 is to cause the gear 84 to be reversely or counterclockwisely rotated, the rotation is effectively prevented because of the engagement between the gear 84 and the stopper 74. In FIG. 4A, the wick 44 is raised to the maximum combustion position. This corresponds to the state shown in FIG. 3A. The further rotation of the wick operating shaft 58 through the knob 70 beyond the maximum combustion position is prevented by the abutment of the pin member 92 against the rod 88 of the gear 84 of which the rotation is stopped by the stopper means 74. If the wick 44 is ignited using a suitable ignition means at this position, maximum normal combustion can be readily carried out.

The wick adjusting device 12 of the illustrated embodiment is adapted to be operated in the state that the return spring 86 is wound up, as described above. When the wick operating shaft 58 is reversely rotated through the knob 70 in the state shown in FIGS. 3A and 4A, the pin member 92 is disengaged from and moved away from the rod 88 to lower the wick 44 to the minimum combustion position shown in FIG. 4B while keeping the winding-up of the return spring 86. One side end of the slot 100 of the regulating means or circular member 94 is abutted against the pin-like projection 90 of the rod 88 at the minimum combustion position as shown in FIG. 3B, thus, the further rotation of the knob 70 is stopped. Thus, it will be noted that the wick adjusting device 12 of the illustrated embodiment allows combustion to be controlled as desired between the maximum combustion position and the minimum combustion position and effectively prevents the lowering of the wick 44 during the combustion operation which will result in abnormal combustion. The shift from the minimum combustion position shown in FIG. 4B to the maximum combustion shown in FIG. 4A is carried out by reversely rotating the wick operating shaft 58 through the knob 70 until the pin member 92 of the wick operating shaft 58 abuts against the rod 88 of the gear 84. The further rotation of the wick operating shaft 58 beyond the maximum combustion position is prevented due to the abutment of the pin member 92 against the rod 88 of the gear 84 kept stationary by the stopper means 74. It is a matter of course that the knob 70 is adapted to be optionally positionally set between the maximum combustion position and the minimum combustion position to carry out desired combustion, as desired.

When it is desired to further rotate the knob 70 in the reverse direction to carry out the fire-extinguishing, the knob 70 is pulled against the spring 98 to release the engagement between the pin-like projection 90 and the slot 100 of the circular member 94, to thereby allow the knob 70 to be rotated to the fire-extinguishing position. The positional relationship among the slot 100, pin-like projection 90 and pin member 92 at the fire-extinguishing is shown in FIG. 3C.

Thus, it will be noted that the illustrated embodiment effectively keeps combustion in the oil burner constantly normal or constantly keeping the combustion position of the wick 44 within a range of carrying out the normal combustion of the oil burner.

Also, in the embodiment, the pin-like projection 90 which is adapted to regulate the minimum combustion position in cooperation with the slot 100 of the circular member 94 is provided on the gear 84. This results in the pin-like projection 90 being rotated together with the gear 84 due to the force of the return spring 86 when the gear 84 is disengaged from the stopper means 74 in an emergency such as earthquakes, to thereby effectively prevent the wick 44 from being stopped at the minimum combustion position to fail in fire-extinguishing.

As can be seen from the foregoing, the wick adjusting device of the present invention effectively and positively keeps the combustion position of the wick within a range of constantly carrying out the normal combustion of the oil burner. Also, the wick adjusting device of the present invention allows the fire-extinguishing to be effectively carried out in an emergency such as earthquakes, resulting in eliminating the operation and/or means for pulling the knob corresponding to the actuation of the automatic fire-extinguishing mechanism.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A device for adjusting the vertical position of a wick for an oil burner comprising:

a wick operating shaft rotated to vertically move said wick;

a shaft actuating means for actuating said wick operating shaft, said shaft actuating means including a knob mounted on one end of said wick operating shaft so as to be slidable on said wick operating shaft in the axial direction thereof;

a gear means loosely fitted on said wick operating shaft, said gear means having an extension means extending therefrom toward said shaft actuating means;

a return spring means interposed between said gear means and a burner body to act on said gear means, said return spring means being wound up at an ordinary state;

a stopper means adapted to be stationary at an ordinary state so that it is engaged with said gear means by force of another spring means to keep said return spring means at the wound-up state and prevent said gear means from being rotated by the force of said wound-up return spring means, and also adapted, when it is actuated, to be released from the engagement with said gear means so that said wound-up return spring means is released to rotate said wick operating shaft to lower said wick to the fire-extinguishing position;

an engagement means provided on said wick operating shaft which is adapted to pressingly engage with said extension means of said gear means to wind up said return spring means when said wick operating shaft is rotated through said shaft actuating means at the state that said return spring means is not wound up;

a forcing means for constantly forcing said shaft actuating means toward said gear means; and a regulating means mounted on said knob to be moved together with said knob, said regulating means being adapted to be engaged with said extension means of said gear means at the minimum combustion position of said wick to stop the rotation of said shaft actuating means in the fire-extinguishing direction and released from the engagement with said extension means to allow said shaft actuating means to be rotated in the fire-extinguishing direction when it is pulled against said forcing means.

2. A device for adjusting the vertical position of a wick for an oil burner as defined in claim 1, wherein said shaft actuating means comprises a knob.

3. A device for adjusting the vertical position of a wick for an oil burner as defined in claim 1, wherein said return spring means includes a return spring fitted on said wick operating shaft so as to be interposed between said burner body and said gear means.

4. A device for adjusting the vertical position of a wick for an oil burner as defined in claim 1, wherein said extension means of said gear means comprises a rod mounted on said gear means to extend therefrom toward said shaft actuating means and a pin-like projection mounted on said rod to extend therefrom to said regulating means.

5. A device for adjusting the vertical position of a wick for an oil burner as defined in claim 1, wherein said forcing means comprises a spring fitted on said wick operating shaft and received in said shaft actuating means.

6. A device for adjusting the vertical position of a wick for an oil burner as defined in claim 1, wherein said regulating means comprises a circular member fitted on said wick operating shaft so as to be interposed between said shaft actuating means and said gear means, said circular member being circumferentially formed with an arcuate slot in which said extension means of said gear means is movably fitted at a part thereof in a manner to be abutted against one side end of said slot at said minimum combustion position to stop relative movement between said part and said slot.

7. A device for adjusting the vertical position of a wick for an oil burner as defined in claim 6, wherein said circular member is securely fitted in said knob.

8. A device for adjusting the vertical position of a wick for an oil burner comprising:

a wick operating shaft rotated to vertically move said wick;

a knob mounted on the distal end of said wick operating shaft so as to rotate said wick operating shaft and be slidable on said wick operating shaft in the axial direction thereof;

a gear loosely fitted on said wick operating shaft and having an extension means provided thereon which comprises a rod mounted on said gear to extend therefrom toward said knob and a pin-like projection mounted on said rod to extend therefrom toward said knob;

a return spring fitted on said wick operating shaft to act on said wick operating shaft, said return spring being positioned between a burner body and said gear and wound up at an ordinary state;

a stopper means adapted to be stationary at an ordinary state so that it is engaged with said gear to keep said return spring at the wound-up state and prevent said gear from being rotated by the force of said wound-up return spring, said stopper means being also adapted to be released from the engagement with said gear so that said wound-up return spring is released to rotate said wick operating shaft to the fire-extinguishing position, when said stopper means is actuated;

an engagement means provided on said wick operating shaft which is adapted to pressingly engage with said extension means of said gear means to wind up said return spring when said wick operating shaft is rotated through said knob at the state that said return spring is not wound up;

a spring fitted on said wick operating shaft and received in said knob so as to constantly force said knob toward said gear; and a circular member fitted on said wick operating shaft and securely fitted in said knob so as to be interposed between said gear and said knob and moved together with said knob, said circular member being circumferentially formed with an arcuate slot in which said pin-like projection of said extensiom means of said gear is movably fitted in a manner to be abutted against one side end of said slot at the minimum combustion position of said wick to stop the relative movement between said pin-like projection and said slot.

* * * * *